US006551461B2

(12) United States Patent
Hermans et al.

(10) Patent No.: US 6,551,461 B2
(45) Date of Patent: Apr. 22, 2003

(54) PROCESS FOR MAKING THROUGHDRIED TISSUE USING EXHAUST GAS RECOVERY

(75) Inventors: Michael Alan Hermans, Neenah, WI (US); Charlcie Christie Kay Leitner, Appleton, WI (US); Frank Stephen Hada, Appleton, WI (US); Ronald Frederick Gropp, St. Catharines (CA); Marek Parszewski, New London, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/918,128

(22) Filed: Jul. 30, 2001

(65) Prior Publication Data

US 2003/0019601 A1 Jan. 30, 2003

(51) Int. Cl.[7] ..... D21F 5/18

(52) U.S. Cl. ..... 162/207; 162/109; 162/290; 34/86; 34/122; 34/123; 34/131; 34/452; 34/513; 34/604; 34/629

(58) Field of Search ..... 162/109, 207, 162/111, 297, 290; 34/86, 123, 131, 604, 35, 452, 513, 629

(56) References Cited

U.S. PATENT DOCUMENTS

| | | | | |
|---|---|---|---|---|
| 1,438,511 A | * | 12/1922 | Witham | 162/290 |
| 1,718,573 A | * | 6/1929 | Millspaugh | 162/207 |
| 3,303,576 A | * | 2/1967 | Sisson | 162/207 |
| 3,447,247 A | | 6/1969 | Daane | |
| 3,849,904 A | | 11/1974 | Villalobos | |
| 4,238,284 A | * | 12/1980 | Huostila et al.. | 162/290 |
| 4,242,808 A | * | 1/1981 | Luthi | 162/207 |
| 4,462,868 A | | 7/1984 | Oubridge et al. | |
| 4,523,390 A | | 6/1985 | McCarthy | |
| 5,105,558 A | | 4/1992 | Curry | |
| 5,225,042 A | * | 7/1993 | Eaton et al. | 162/290 |
| 5,306,395 A | | 4/1994 | Myren | |
| 5,385,644 A | * | 1/1995 | Hannus et al. | 162/207 |
| 5,397,437 A | | 3/1995 | Ingemar | |
| 5,672,248 A | | 9/1997 | Wendt et al. | |
| 5,784,801 A | | 7/1998 | Thorp et al. | |
| 5,974,691 A | | 11/1999 | Marchal et al. | |

FOREIGN PATENT DOCUMENTS

EP 0 574 366 A1 12/1993

OTHER PUBLICATIONS

Patent Coorperation Treaty Search Report from the International Search Authority, International Application No. PCT/US 02/08518 dated Jul. 19, 2002.

* cited by examiner

*Primary Examiner*—Peter Chin
(74) *Attorney, Agent, or Firm*—Gregory E. Croft

(57) ABSTRACT

The energy efficiency of a throughdrying papermaking process is improved by recycling exhaust air from one or more throughdryers to further heat the web at various places in the process.

14 Claims, 3 Drawing Sheets

PROCESS FOR MAKING THROUGHDRIED TISSUE USING EXHAUST GAS RECOVERY

BACKGROUND OF THE INVENTION

In the manufacture of high-bulk paper webs such as facial tissue, bath tissue, paper towels and the like, it is common to use one or more throughdryers to bring the paper web to final dryness or near-final dryness. Generally speaking, throughdryers are rotating cylinders having an open deck that supports a drying fabric which, in turn, supports the web being dried. Heated air is provided by a hood above the drying cylinder and is passed through the web while the web is supported by the drying fabric. During this process, the heated air is cooled while increasing in moisture. This spent air is exhausted from the interior of the drying cylinder via a fan that pulls the air through the web and recycles it to a burner. The burner reheats the spent air, which is then recycled back to the throughdryer. To complete the process, a portion of the exhaust air is removed and a proportional amount of fresh, dry air is pulled into the system to avoid a build-up of moisture in the drying air system. The portion of the exhaust air that is removed is either vented or used to heat process water.

Throughdrying papermaking machines utilize a boiler to supply steam to steam boxes located over vacuum boxes that are used to dewater the web prior to throughdrying. If a Yankee dryer is present to complete the drying operation and/or to crepe the dried web, the boiler also provides steam to the Yankee.

While such throughdrying operations have been successful, energy costs today are increasing substantially. Also, the capital costs associated with the installation of a boiler are significant. Therefore there is a need to further reduce the costs associated with the throughdrying process.

SUMMARY OF THE INVENTION

It has now been fortuitously discovered that the heat value of throughdryer exhaust air can be used advantageously by recycling the exhaust air to heat the web at any point in the papermaking process after the web has been formed. Unlike boiler-generated steam, the exhaust air is a mixture of air and water vapor, but nevertheless has been found to contain sufficient heat value to obtain a benefit. It is particularly advantageous to use the recycled exhaust air to replace boiler-generated steam used to partially dewater the web after formation and prior to drying. It is believed that the heat transferred upon condensation of the steam on the web decreases the viscosity and surface tension of the water in the web, thereby increasing drainage. A supply plenum can be positioned over one or more of the existing vacuum boxes to introduce the recycled exhaust air to the web. The vacuum provided by the associated vacuum box beneath the supply plenum (and the slight pressure from the throughdryer exhaust fan) can provide sufficient motive force to pull the exhaust air through the web without the need for a compressor. In addition, the use of the throughdryer exhaust air in this manner eliminates the need and capital investment associated with having a boiler as a source of steam. As used herein, a "supply plenum" is any enclosure that serves to introduce the exhaust air to the web and confine the exhaust air within the vicinity of the web such that the exhaust air is drawn through the web into the vacuum box on the opposite side of the web. Advantageously, it can simply be a "box" fabricated of sheet metal. However, if a papermaking machine already has steam boxes in place, the steam boxes can serve as supply plenums as well.

Hence, in one aspect, the invention resides in a process for making tissue comprising: (a) forming a wet tissue web by depositing an aqueous suspension of papermaking fibers onto a forming fabric; (b) partially dewatering the wet tissue web while the wet tissue web is supported by a papermaking fabric; (c) drying the wet web in one or more throughdryers, wherein heated drying air gathers moisture from the wet web as it is passed through the wet web and is exhausted from the throughdryer(s); (d) winding the dried web into a parent roll; and (e) recycling exhaust air from one or more of the throughdryers to heat the web and/or a bare papermaking fabric at one or more points in the process between the steps of forming the web and winding the dried web into a parent roll.

If two, three, four or more throughdryers are used in series, the moisture content of the exhaust air from each of the throughdryers can be different. Therefore, as used herein, a "primary" throughdyer is the throughdryer having the exhaust air with highest moisture content. Other throughdryers are considered to be "secondary" throughdryers. In most instances where two throughdryers are being used, it is advantageous that the exhaust air from the first throughdryer be recycled to the supply plenum because the first throughdryer is the primary throughdryer. However, should the two throughdryers be operated in a manner that reverses the relative moisture contents such that the second throughdryer becomes the primary throughdryer, then the second throughdryer exhaust air could advantageously be used for the dewatering operation rather than the exhaust air of the first throughdryer.)

Optionally, the exhaust air from the second throughdryer or other secondary throughdryers, which generally have a lower moisture content and higher temperature, can be used to heat the dewatered web and/or its carrying fabric(s) prior to entering the first throughdryer in order to further improve energy efficiency. Suitable locations to introduce secondary throughdryer exhaust air to the dewatered web include any point after the dewatered web has been transferred from the forming fabric and before the web contacts the throughdrying cylinder. Such locations can be while the web is supported by the transfer fabric and/or while the web is in contact with the throughdryer fabric. A suitable location to introduce the exhaust air to a bare papermaking fabric would be the span of the transfer fabric returning from the throughdryer fabric and prior to receiving the newly-formed web from the forming fabric. When the recycled exhaust air is used for heating and drying a bare fabric, the exhaust air can simply be blown onto the fabric using the pressure created by the exhaust fan, or it can be drawn through the fabric with the aid of a vacuum box or roll positioned on the opposite side of the fabric. By reducing the amount of water in the fabric, particularly if the fabric has been cleaned using a water spray, rewetting of the web is reduced during subsequent contact with the fabric. This reduction in rewetting lowers the burden on the throughdryers, which in turn allows the papermaking machine to run faster. Alternatively, or in addition to the aforementioned recycle configurations, the exhaust air from the second throughdryer or other secondary throughdryer can be directed to the dried web after the second throughdryer and prior to being wound into a parent roll in order to further dry the web or prevent moisture absorption from the ambient air.

If multiple vacuum boxes are used to dewater the web prior to the throughdrying step, it is advantageous to position the supply plenum over the vacuum box with the largest flow to take advantage of the large volume of air associated with the exhaust. The flow is determined by the combination of the vacuum slot or opening and the vacuum level in the particular vacuum box. Increased flow means more recovered steam and hence more dewatering. However, the supply plenum can be positioned over two or more vacuum boxes if desired.

The temperature of the exhaust air leaving the throughdryer for recycle to the supply plenum can be from about 100° C. (212° F.) to about 249° C. (480° F.), more specifically from about 104° C. (220° F.) to about 138° C. (280° F.). Higher temperatures will increase the dewatering effect.

The water vapor content of the exhaust air leaving the throughdryer for recycle to the supply plenum can be from about 5 to about 35 weight percent, more specifically from about 10 to about 30 weight percent, still more specifically from about 20 to about 25 weight percent. Higher water vapor content increases the dewatering effect.

The flow rate of the exhaust air recycled to the supply plenum can be from about 2268 to about 9072 kilograms per hour (5,000 to about 20,000 pounds per hour), more specifically from about 4536 to about 9072 kilograms per hour (10,000 to about 20,000 pounds per hour). The desired flow rate will be a function of several factors, including the production speed of the papermaking machine, the basis weight of the web, the kinds of fibers making up the web, the level of vacuum, and the vacuum slot or hole size. Increasing the flow rate will increase the dewatering effect.

Accordingly, production speeds can be about 305 meters per minute (mpm) (1000 feet per minute (fpm)) or greater, more specifically from about 305 mpm to about 1829 mpm (1000 fpm to about 6000 fpm), and still more specifically from about 914 mpm to about 1524 mpm (3000 fpm to about 5000 fpm). Increasing production speeds will decrease the dewatering effect while keeping all other conditions the same.

The basis weight of the web can be from about 10 to about 80 grams per square meter (gsm), more specifically from about 10 to about 50 gsm and even more specifically from about 20 to 35 gsm. The basis weight will depend on the nature of the product, such as facial tissue, bath tissue or towel, as well as the number of plies to be used in the final converted product. Increasing the basis weight while other conditions remain unchanged will decrease the permeability of the web and will generally decrease the dewatering effect.

The exhaust air flow through the web can be about 5 pounds or greater of exhaust air per pound of fiber, more specifically about 10 pounds or greater of exhaust air per pound of fiber, still more specifically about 20 pounds of exhaust air per pound of fiber, still more specifically about 25 pounds of exhaust air per pound of fiber, and still more specifically from about 15 to about 50 pounds of exhaust air per pound of fiber.

The fibers used in the web can be any suitable papermaking fiber, such as softwood fibers, hardwood fibers and/or synthetic fibers. The softwood and hardwood fibers can beprovided by any of a number of commonly used pulping processes, such as chemical, thermal, mechanical, thermomechanical, and chemithermomechanical. Fibers having a higher coarseness will create a more open web structure and will improve the dewatering effect.

The vacuum level needed to pull the exhaust air from the throughdryer(s) can be about 127 millimeters (mm) (5 inches) of mercury or greater, more specifically from about 254 to about 737 mm (10 to about 29 inches) of mercury, still more specifically from about 381 to about 508 mm (15 to about 20 inches) of mercury. Higher vacuum levels will increase flow and increase the dewatering effect with other process parameters unchanged.

The size of the vacuum slot or holes (open area exposed to the web) can be about 0.5 square centimeters or greater per centimeter (0.20 square inches or greater per inch) of web width, more specifically from about 0.5 to about 10 square centimeters per centimeter (0.20 to about 3.9 square inches per inch) of web width. Greater open area will increase airflow through the web and increase the dewatering effect with other process parameters unchanged.

The recycled exhaust air can increase the temperature of the web and/or the fabric about 10° C. (18° F.) or greater, more specifically about 15° C. (27° F.) or greater, still more specifically about 20° C. (36° F.) or greater, still more specifically about 25° C. (45° F.) or greater, and still more specifically from about 25° C. (45° F.) to about 50° C. (90° F.). Greater temperature increases in the web reflect a lowering of the surface tension and viscosity of the water in the web, and therefore correlate with an increase in the dewatering effect if all other parameters are unchaged. The temperature increase of the web and/or the fabric can be measured, for example, by using an infrared detector.

Also, the consistency of the web can increase about 1 absolute percent or greater, more specifically about 1.5 absolute percent or greater, and still more specifically from about 2 absolute percent to about 4 absolute percent. For example, starting with a consistency of 26 percent, the increase in the consistency can be from 26 to about 27 percent, more specifically from 26 to about 27.5 percent, and still more specifically from 26 to about 28 to 30 percent. Note this is the consistency increase attributable to the recovered water vapor only. Since the web is concurrently exposed to vacuum as well, the total consistency increase due to both the water vapor recovery and the vacuum can be 10 absolute percent or greater. However, a consistency increase of 1 absolute percent translates to a speed increase of roughly 5 percent for a drying-limited tissue machine.

The ratio of the recovered water vapor to fiber can be about 1 kilogram or greater of water vapor recovered per kilogram of fiber (pound of water vapor per pound of fiber), more specifically about 2 kilograms or greater of water vapor per kilogram of fiber (pounds of water vapor per pound of fiber), and more specifically about 3 kilograms or greater of water vapor per kilogram of fiber (pounds of water vapor per pound of fiber). Greater amounts correlate with an increase in the dewatering effect if other conditions remain unchanged.

The ratio of recovered water vapor to water in the sheet can be at least 0.25 kilograms of vapor per kilogram of water in the sheet, preferably at least 0.3 kilograms of vapor per kilogram of water (pounds of vapor per pound of water) in the sheet, more preferably at least 0.4 kilograms of vapor per kilogram of water (pounds of vapor per pound of water) in the sheet, and most preferably, at least 0.5 kilograms of vapor per kilogram of water (pounds of vapor per pound of water) in the sheet. Kilograms of water in the sheet refers to the amount of water in the sheet present when the sheet first contacts the recovered air/water vapor stream. For a single vacuum box, this would be determined from the incoming consistency and basis weight. For a multiple box/slot system, this is determined from the incoming consistency and basis weight at the first box or slot where the heat recovery is utilized.

The drying energy efficiency can be increased (the drying load decreased) in direct proportion to the additional water removed via the heat recovery, especially for drying-limited machines. For example, if the consistency is increased from 25 percent to 28 percent (moisture ratio reduced from 3.00 to 2.57 kilograms of water per kilogram of fiber (pounds of water per pound of fiber)) via the heat recovery, the energy requirement in the throughdryers can be reduced by approximately 15 percent. Hence, for a machine that is drying limited, the speed can be increased by approximately 15 percent, thus realizing greater production.

DETAILED DESCRIPTION OF THE DRAWINGS

Figure 1:
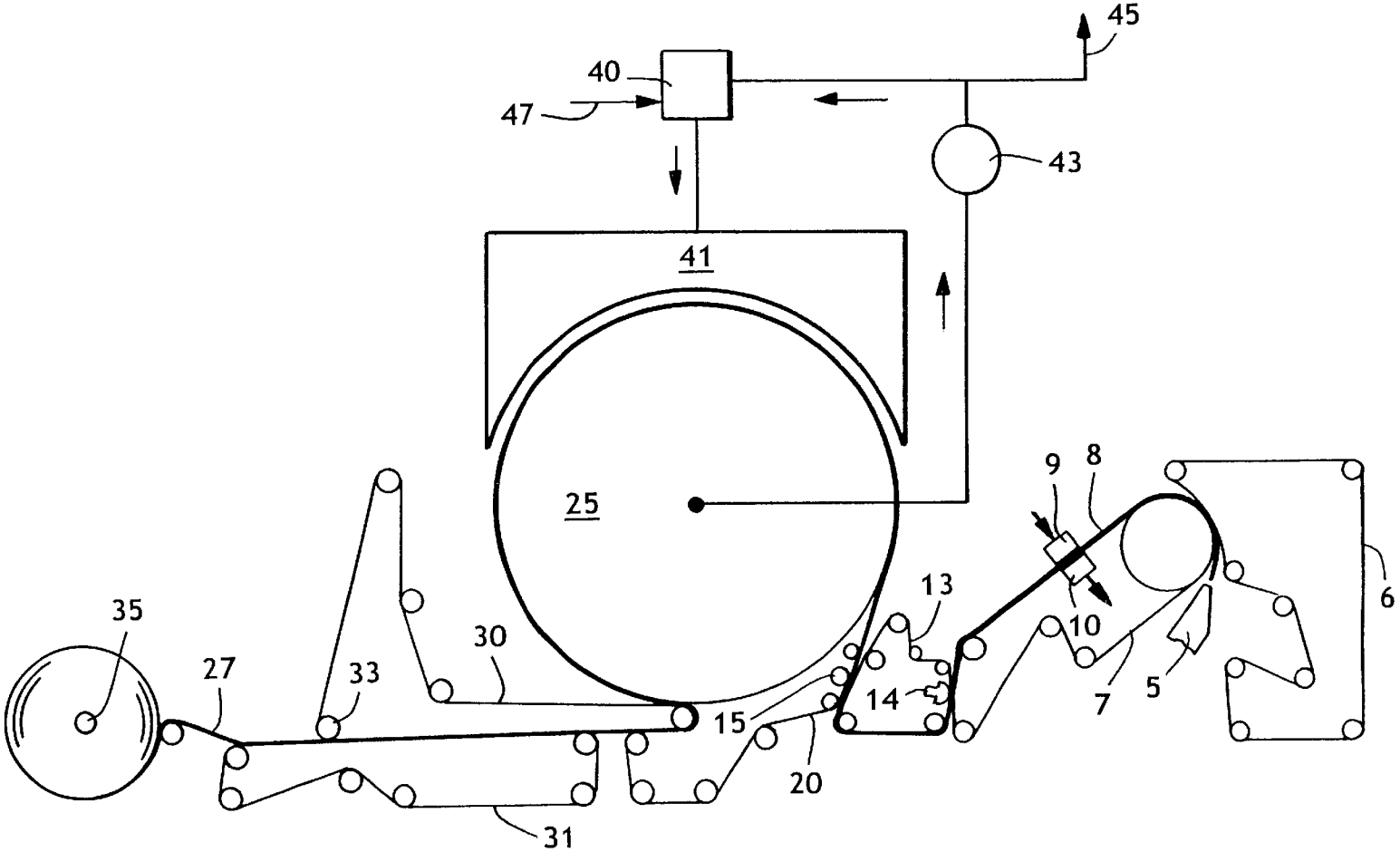
FIG. 1 PRIOR ART
FIG. 1 is a schematic process flow diagram of a prior art uncreped throughdrying process, similar to that disclosed by U.S. Pat. No. 5,672,248 issued Sep. 30, 1997 to Wendt et al., which is herein incorporated by reference.

Referring to the figures, the invention will be described in greater detail. For comparison, FIG. 1 illustrates a prior art throughdrying process. Shown is a twin wire former having a layered papermaking headbox 5 which injects or deposits a stream of an aqueous suspension of papermaking fibers between two forming fabrics 6 and 7. Forming fabric 7 serves to support and carry the newly-formed wet web 8 downstream in the process as the web is partially dewatered to a consistency of about 10 dry weight percent. Additional dewatering of the wet web can be carried out, such as by vacuum suction, using one or more steam boxes 9 in conjunction with one or more vacuum suction boxes 10 while the wet web is supported by the forming fabric 7.

The wet web 8 is then transferred from the forming fabric 7 to a transfer fabric 13 traveling at a slower speed than the forming fabric in order to impart increased MD stretch into the web. A transfer is carried out to avoid compression of the wet web, preferably with the assistance of a vacuum shoe 14.

The web is then transferred from the transfer fabric 13 to the throughdrying fabric 20 with the aid of a vacuum transfer roll 15 or a vacuum transfer shoe. Transfer is preferably carried out with vacuum assistance to ensure deformation of the sheet to conform to the throughdrying fabric, thus yielding desired bulk, flexibility, CD stretch and appearance.

The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric 20, the web is dried to a final consistency of about 94 percent or greater by the throughdryer 25 and thereafter transferred to a carrier fabric 30. The dried basesheet 27 is transported to the reel 35 using carrier fabric 30 and an optional carrier fabric 31. An optional pressurized turning roll 33 can be used to facilitate transfer of the web from carrier fabric 30 to fabric 31. Although not shown, reel calendering or subsequent off-line calendering can be used to improve the smoothness and softness of the basesheet.

The hot air used to dry the web while passing over the throughdryer is provided by a burner 40 and distributed over the surface of the throughdrying drum using a hood 41. The air is drawn through the web into the interior of the throughdrying drum via fan 43 which serves to circulate the air back to the burner. In order to avoid moisture build-up in the system, a portion of the spent air is vented 45, while a proportionate amount of fresh make-up air 47 is fed to the burner.

Figure 2:
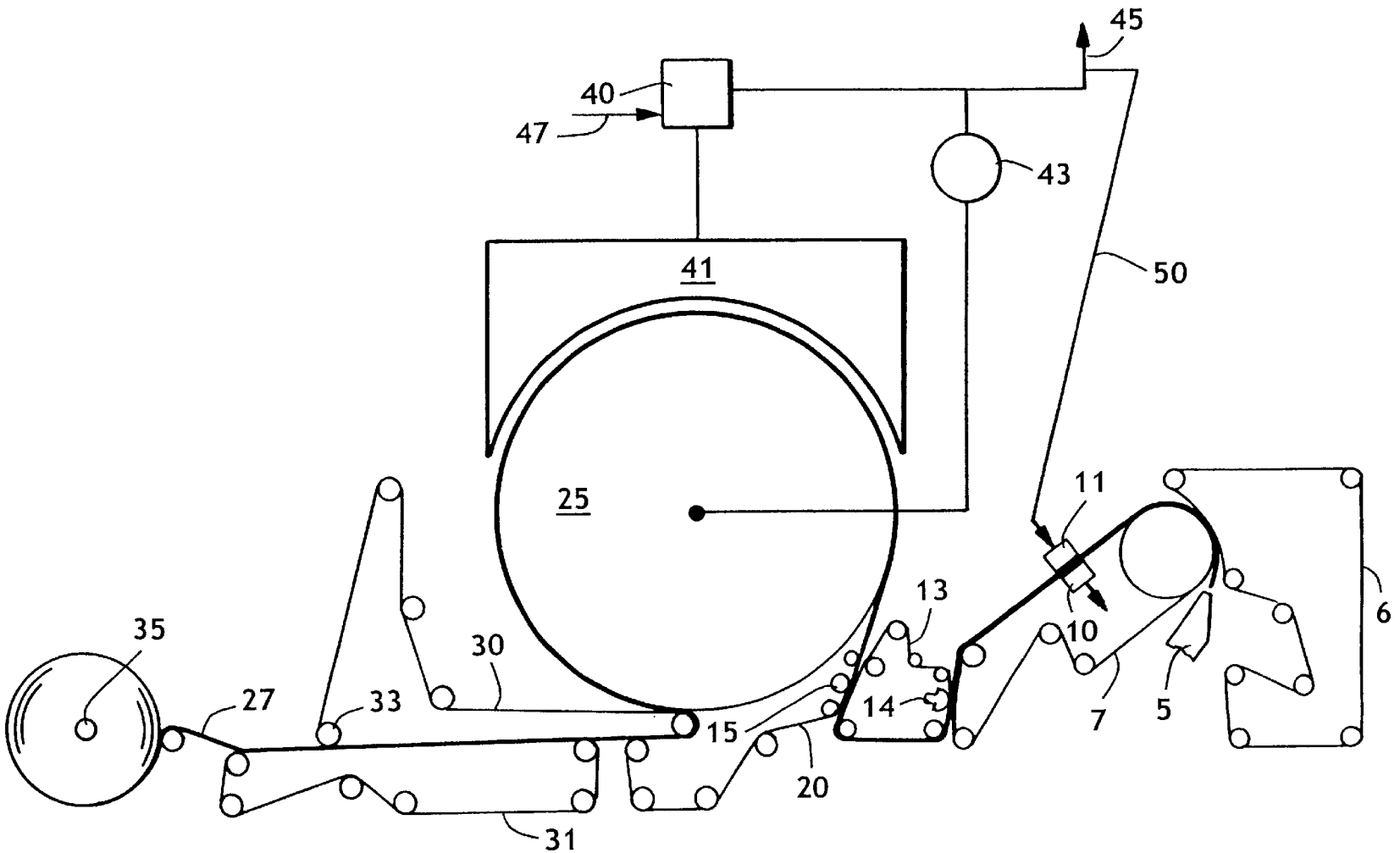
FIG. 2 is a schematic process flow diagram of a throughdrying process in accordance with this invention, illustrating an uncreped throughdrying process with only one throughdryer.

FIG. 2 is a schematic process flow diagram of a throughdrying process in accordance with this invention. Shown is the overall process setting as shown and described in FIG. 1. In addition, shown is the exhaust air recycle stream 50 which provides exhaust airto the supply plenum 11 operatively positioned in the vicinity of one or more vacuum suction boxes 10, such that exhaust air fed to the supply plenum is drawn through the web, through the papermaking fabric and into the vacuum box(es).

Figure 3:
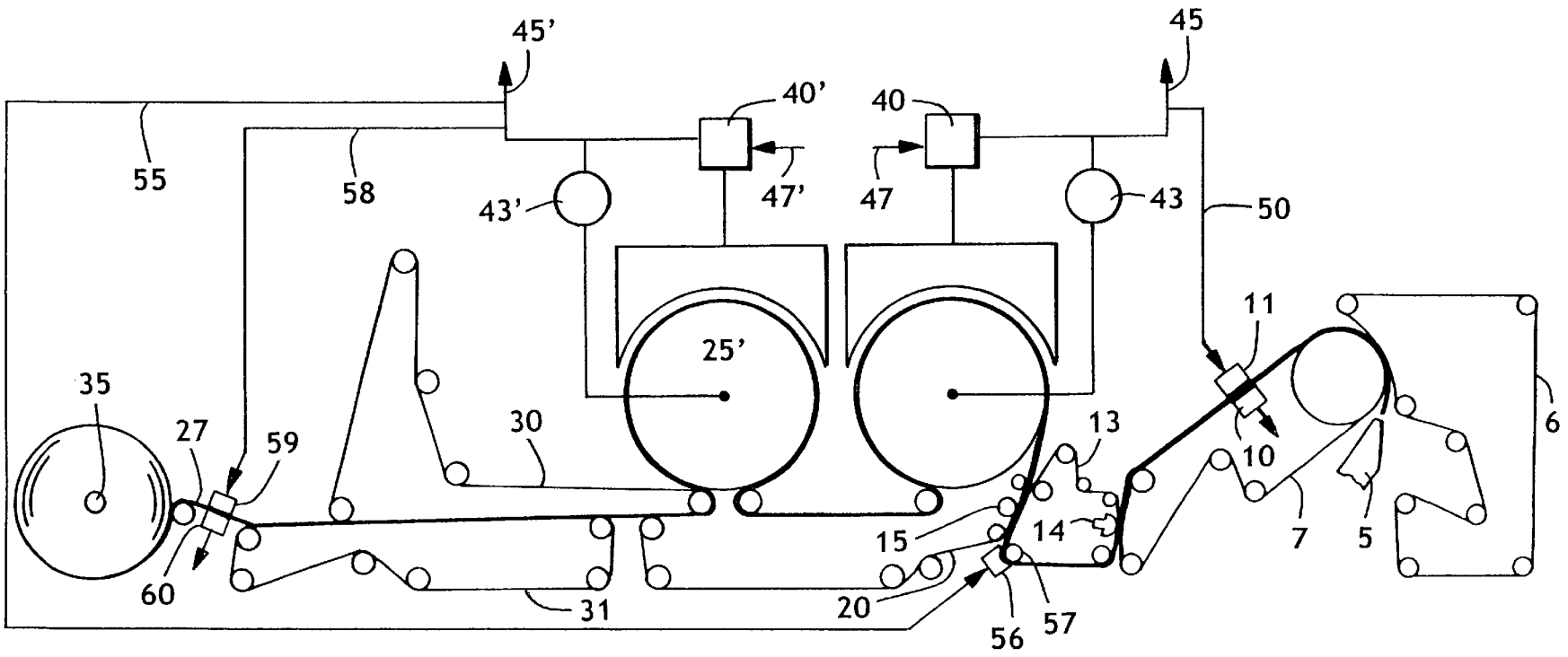
FIG. 3 is a schematic process flow diagram of a throughdrying process in accordance with this invention, illustrating an uncreped throughdrying process having two throughdryers in series.

FIG. 3 is a schematic process flow diagram of another throughdrying process in accordance with this invention, similar to that illustrated in FIG. 2, but in which two throughdryers are used in series to dry the web. The components of the second throughdryer are given the same reference numbers used for the first throughdryer, but distinguished with a "prime". When two throughdryers are used, the exhaust air from the first throughdryer is recycled to the plenum 11 because of its relatively greater heat value. As previously noted, if the throughdryers are operated in such a fashion that the relative heat value of the second throughdryer is greater than the first for the given application, the exhaust air from the second throughdryer can be used for the recycle stream to the plenum 11.

Optionally, exhaust air from the second throughdryer can be used to heat the dewatered web by providing an exhaust air recycle stream 55 which, as shown, is directed to a plenum 56 opposite vacuum roll 57. Any of the web-contacting vacuum rolls in the vicinity of vacuum roll 57, such as vacuum roll or shoe 15, are also suitable locations for introducing the exhaust air. In addition, as previously mentioned, the exhaust air can be used to heat the bare transfer fabric, such as in the area of reference number 13.

Optionally, exhaust air from the second throughdryer can also be used to heat the dried web after leaving the second throughdryer by providing an exhaust air recycle stream 58 which directs the hot air to a plenum 59 opposite a vacuum box 60.

EXAMPLES

Example 1

A three-layered tissue sheet was made in accordance with the process illustrated in FIG. 2. More specifically, a web comprising 34 percent northern softwood kraft fiber and 66 percent eucalyptus (eucalyptus fibers in the outer two layers and softwood fibers in the center layer) was formed on a Voith Fabrics 2164-B forming fabric using standard forming equipment. The stock was not refined and 6 kilograms of Parez® wet strength agent per ton of fiber was added to the center layer. The basis weight of the sheet was 20 gsm and the forming fabric was traveling 610 mpm (2000 feet per minute). The sheet was vacuum dewatered by passing the sheet over four vacuum boxes with slot widths of 1.905, 1.588, 1.270 and 2×1.905 (double slot) centimeters (0.75, 0.625, 0.50, and 2×0.75 inches), and operating at vacuums of 342.9, 412.8, 444.5 and 495.3 millimeters (13.50,16.25, 17.50,19.50 inches) of mercury, respectively. The consistency of the sheet prior to the fist vacuum box was 15.9 percent and the consistency after vacuum dewatering was 28.0 percent. The sheet temperature was approximately 19° C. (66° F.) prior to and after the vacuum boxes.

The web was then transferred to an Appleton Mills t807-1 transfer fabric using 25 percent rush transfer. The web was then vacuum transferred to a Voith Fabrics t1205-1 through-drying fabric and carried over two identical throughdryers where the web was dried. The throughdryer gas flows and temperatures were set to achieve approximately 1.5 percent moisture after the dryers. The web was then wound using a standard reel.

The supply plenum located over the last vacuum box was then lowered to within approximately 0.635 centimeters (0.25 inches) of the sheet and a portion of the air from the first throughdryer exhaust diverted to the supply plenum. The supply plenum had a 10.16-centimeter (four-inch) opening and was centered on the vacuum box containing the 2×1.905 centimeter (2×0.75 inch) slots. The air mass flow rate was 105 kg per minute (231 pounds/minute) and the air contained 0.10 kilograms vapor per kilogram of air (pounds vapor per pound air), or about 10 kilograms/minute (23 pounds/minute) of vapor.

The temperature of the diverted exhaust air was 135° C. (275 F.) and the air was discharged immediately above the sheet where the final vacuum box could pull a portion of the exhaust air through the sheet. The sheet temperature exiting the last vacuum slot increased to 51° C. (124° F.) and the post-vacuum box consistency increased to 30.3 percent. Hence the heat recovery led to a consistency increase across the vacuum box of 2.3 percent more (30.3 percent versus 28.0 percent) than that achieved without the heat recovery system. The remainder of the process was not changed, except the throughdryer temperatures were decreased to maintain a constant moisture at the reel.

Example 2

The process of Example 1 was repeated with the exception that the basis weight of the sheet was increased to 32 gsm. Again a control was run without the heat recovery. In this case, the vacuum levels in the boxes were 355.6, 431.8, 431.8 and 495.3 millimeters (14.00, 17.00, 17.00 and 19.50 inches) of mercury, respectively. The consistency before the first vacuum box was 17.7 percent and the consistency after the final vacuum box was 27.8 percent. The sheet temperature before and after the final vacuum box was 20° C. (68° F.).

The heat recovery system was then engaged and the first throughdryer exhaust air was again routed to the supply plenum over the final vacuum box. Under these conditions, the exhaust air mass flow rate through the recovery duct was 103 kilograms per minute (226 pounds per minute) and the humidity was 0.15 kilograms vapor per kilogram of air (pounds vapor per pound air), or approximately 15 kilograms per minute (34 pounds per minute) of vapor. The exhaust gas temperature at these conditions was 125° C. (257° F.). This increased the sheet temperature to 53° C. (128° F.) and the sheet consistency to 29.6 percent (from 27.8 percent) after the supply plenum. This was a 1.8 percent increase over the control condition without heat recovery. The remaining process conditions were unchanged.

Example 3

Another set of conditions was run at 914 mpm (3000 fpm) with similar process and machine parameters. In the first control situation, the sheet was 20 gsm and the four vacuum slot vacuums were 355.6, 431.8, 457.2 and 495.3 millimeters (14.0, 17.0, 18.0, 19.5, and 19.0 inches) of mercury, respectively. The consistency of the sheet coming into the dewatering section was 15.1 percent and leaving it was 26.4 percent. The sheet temperature was about 23° C. (73° F.) before and after the supply plenum.

The supply plenum was then lowered to the sheet and the exhaust air redirected to it. The exhaust air mass flow rate was 99 kilograms/minute (219 pounds/minute) and contained 0.18 kilograms vapor per kilogram air (pounds vapor per pound air), or 18 kilograms vapor per minute (39 pounds vapor per minute). The temperature of the recovered exhaust air at this condition was 134° C. (273° F.). This increased the sheet temperature after the supply plenum to 53° C. (128° F.) from 23° C. (73° F.). The sheet consistency leaving the slot was 28.3 percent, an increase of 1.9 percent (up from 26.4 percent).

Example 4

The machine was set up for a 32 gsm sheet and a forming fabric speed of 914 mpm (3000 fpm). The vacuum box vacuums were at 444.5, 495.3, 482.6 and 558.8 millimeters (17.5, 19.5, 19 and 22 inches) of mercury, respectively. The consistency of the sheet coming into the first vacuum box was 17.7 percent and leaving the last vacuum box, the sheet was at 26.2 percent consistency.

When the heat recovery was engaged and the supply plenum lowered over the sheet, the air mass flow of the exhaust air was 102 kilograms per minute (224 pounds per minute and the humidity was 0.17 kilograms vapor per kilogram air (pounds vapor per pound air), or 17 kilograms vapor per minute (38 pounds vapor per minute). The temperature of the recovered exhaust air was 121° C. (249° F.) and increased the sheet to 53° C. (128° F.) as it left the last vacuum box. The corresponding consistency of the sheet was 26.9 percent. This is an increase of 0.7 percent from 26.2 percent without the heat recovery engaged.

The results of the foregoing examples are summarized in the following table.

| | | Post Vac % Consistency | | % C Gain | ΔT Across Vac [° C. (° F.)] | | Exhaust Recovered [kg/kg (lb/lb)] | |
|---|---|---|---|---|---|---|---|---|
| Example | BW (gsm) | w/o heat | w/heat | (w/−w/o) | w/o heat | w/heat | vapor/fiber | vapor/water in sheet |
| | | | | 610 mpm (2000 fpm) | | | | |
| 2 | 32 | 27.8 | 29.6 | 1.8 | 0.56 (1) | 33 (60) | 2.5 | 0.48 |
| 1 | 20 | 28.0 | 30.3 | 2.3 | −0.56 (−1) | 32 (58) | 2.6 | 0.46 |
| | | | | 914 mpm (3000 fpm) | | | | |

-continued

| Example | BW (gsm) | Post Vac % Consistency w/o heat | Post Vac % Consistency w/heat | % C Gain (w/−w/o) | ΔT Across Vac [° C. (° F.)] w/o heat | ΔT Across Vac [° C. (° F.)] w/heat | Exhaust Recovered [kg/kg (lb/lb)] vapor/fiber | Exhaust Recovered [kg/kg (lb/lb)] vapor/water in sheet |
|---|---|---|---|---|---|---|---|---|
| 4 | 32 | 26.2 | 26.9 | 0.7 | 0 (0) | 31 (55) | 1.9 | 0.39 |
| 3 | 20 | 26.4 | 28.3 | 1.9 | 1 (2) | 31 (56) | 3.3 | 0.63 |

It will be appreciated that the foregoing examples and description, given for purposes of illustration, are not to be construed as limiting the scope of this invention, which is defined by the following claims and all equivalents thereto.

We claim:

1. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are two throughdryers in series such that the partially dewatered web is partially dried in the first throughdryer and thereafter is further dried in the second throughdryer, wherein exhaust air from the second throughdryer is recycled to heat a bare papermaking fabric prior to the first throughdryer.

2. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are two throughdryers in series such that the partially dewatered web is partially dried in the first throughdryer and thereafter is further dried in the second throughdryer, wherein exhaust air from the second throughdryer is recycled to heat the dried web prior to being wound into the parent roll.

3. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are two throughdryers in series such that the partially dewatered web is partially dried in the first throughdryer and thereafter is further dried in the second throughdryer, wherein exhaust air from the first throughdryer is recycled to heat a bare papermaking fabric prior to the first throughdryer.

4. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are two throughdryers in series such that the partially dewatered web is partially dried in the first throughdryer and thereafter is further dried in the second throughdryer, wherein a portion of the exhaust air from the second throughdryer is recycled to heat the dried web prior to being wound into the parent roll and another portion of the exhaust air from the second throughdryer is recycled to heat the partially dewatered web prior to the first throughdryer.

5. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are two throughdryers in series such that the partially dewatered web is partially dried in the first throughdryer and thereafter is further dried in the second throughdryer, wherein a portion of the exhaust air from the second throughdryer is recycled to heat the dried web prior to being wound into the parent roll and another portion of the exhaust air from the second throughdryer is recycled to heat a bare papermaking fabric prior to the first throughdryer.

6. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are two throughdryers in series such that the partially dewatered web is partially dried in the first throughdryer and thereafter is further dried in the second throughdryer, wherein exhaust air from the first throughdryer is recycled to heat the partially dewatered web and wherein exhaust air from the second throughdryer is recycled to heat a bare papermaking fabric prior to the first throughdryer.

7. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are two throughdryers in series such that the partially dewatered web is partially dried in the first throughdryer and thereafter is further dried in the second throughdryer, wherein exhaust air from the first throughdryer is recycled to heat the partially dewatered web and wherein exhaust air from the second throughdryer is recycled to heat the dried web prior to being wound into the parent roll.

8. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are three or more throughdryers in series such that the partially dewatered web is partially dried in a first throughdryer and thereafter is further dried in two or more secondary throughdryers, wherein exhaust air from a secondary throughdryer is recycled to heat a bare papermaking fabric prior to the first throughdryer.

9. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are three or more throughdryers in series such that the partially dewatered web is partially dried in a first throughdryer and thereafter is further dried in two or more secondary throughdryers, wherein exhaust air from a secondary throughdryer is recycled to heat the dried web prior to being wound into the parent roll.

10. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are three or more throughdryers in series such that the partially dewatered web is partially dried in a first throughdryer and thereafter is further dried in the two or more secondary throughdryers, wherein exhaust air from the first throughdryer is recycled to heat a bare papermaking fabric prior to the first throughdryer.

11. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are three or more throughdryers in series such that the partially dewatered web is partially dried in a first throughdryer and thereafter is further dried in two or more secondary throughdryers, wherein exhaust air from one or more secondary throughdryers is recycled to heat the dried web prior to being wound into the parent roll and exhaust air from one or more secondary throughdryers is recycled to heat the partially dewatered web prior to the first throughdryer.

12. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are three or more throughdryers in series such that the partially dewatered web is partially dried in a first throughdryer and thereafter is further dried in one or more secondary throughdryers, wherein exhaust air from one or more secondary throughdryers is recycled to heat the dried web prior to being wound into the parent roll and exhaust air from one or more secondary throughdryers is recycled to heat a bare papermaking fabric prior to the first throughdryer.

13. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are three or more throughdryers in series such that the partially dewatered web is partially dried in a first throughdryer and thereafter is further dried in two or more secondary throughdryers, wherein exhaust air from the first throughdryer is recycled to heat the partially dewatered web and wherein exhaust air from one or more secondary throughdryers is recycled to heat a bare papermaking fabric prior to the first throughdryer.

14. A process for making tissue comprising:

(a) forming a wet tissue web by depositing an aqueous suspension of papermaking fibers onto a forming fabric;

(b) partially dewatering the wet tissue web while the wet tissue web is supported by a papermaking fabric;

(c) drying the wet web in one or more throughdryers, wherein heated drying air gathers moisture from the wet web as it is passed through the wet web and is exhausted from the throughdryer(s);

(d) winding the dried web into a parent roll; and (e) recycling exhaust air from one or more of the throughdryers to heat the web and/or a bare papermaking fabric at one or more points in the process between the steps of forming the web and winding the dried web into a parent roll, wherein there are three or more throughdryers in series such that the partially dewatered web is partially dried in a first throughdryer and thereafter is further dried in two or more secondary throughdryers, wherein exhaust air from the first throughdryer is recycled to heat the partially dewatered web and wherein exhaust air from one or more of the secondary throughdryers is recycled to heat the dried web prior to being wound into the parent roll.

* * * * *